US006097018A

United States Patent [19]

Kim et al.

[11] Patent Number: 6,097,018

[45] Date of Patent: Aug. 1, 2000

[54] CIRCULAR POLARIZATION GENERATING SYSTEM FOR MICROWAVE OVEN

[75] Inventors: Hyun-Jung Kim, Chungchongnam-do; Hyung-Joo Kang, Seoul; Han-Seok Kim, Kyungyi-do; Sang-Jin Oh; Sang-Jin Kim, both of Kyungsangnam-do, all of Rep. of Korea

[73] Assignee: LG Electronics Inc., Rep. of Korea

[21] Appl. No.: 09/227,055

[22] Filed: Jan. 7, 1999

[30] Foreign Application Priority Data

| | | | |
|---|---|---|---|
| Apr. 6, 1998 | [KR] | Rep. of Korea | 98-12150 |
| Jul. 13, 1998 | [KR] | Rep. of Korea | 98-28215 |
| Jul. 13, 1998 | [KR] | Rep. of Korea | 98-28216 |

[51] Int. Cl.[7] ..... H05B 6/72

[52] U.S. Cl. ..... 219/746; 219/748; 219/750; 219/695

[58] Field of Search ..... 219/748, 749, 219/746, 747, 750, 695, 697; 333/227, 239

[56] References Cited

U.S. PATENT DOCUMENTS

| | | | |
|---|---|---|---|
| 2,704,802 | 3/1955 | Blass et al. | 219/746 |
| 3,210,511 | 10/1965 | Smith | 219/748 |
| 4,642,435 | 2/1987 | Fitzmayer et al. | 219/749 |
| 4,808,784 | 2/1989 | Ko | 219/746 |

FOREIGN PATENT DOCUMENTS

| | | | |
|---|---|---|---|
| 63-279595 | 11/1988 | Japan | 219/746 |

*Primary Examiner*—Philip H. Leung
*Attorney, Agent, or Firm*—Ostrolenk, Faber, Gerb & Soffen, LLP

[57] ABSTRACT

A microwave oven includes a magnetron for generating electromagnetic wave energy, a waveguide for guiding and directing the electromagnetic wave energy into a cavity body defining a cooking chamber, and an antenna for radiating the electromagnetic wave energy generated by the magnetron into the waveguide. The waveguide includes a first opening for uniformly dispersing the electromagnetic wave energy into the cooking chamber, a second opening for uniformly dispersing the electromagnetic wave energy into the cooking chamber, and a short circuit for providing a short surface to the antenna. The first opening is formed on a portion of the waveguide which contacts the cavity body and extends along a longitudinal direction. The second opening is spaced away from and having a predetermined angle with respect to the first opening.

21 Claims, 12 Drawing Sheets

CIRCULAR POLARIZATION GENERATING SYSTEM FOR MICROWAVE OVEN

BACKGROUND OF THE INVENTION

1) Field of the Invention

The present invention relates to a microwave oven, and more particularly, to a waveguide for a microwave oven that can enhance the heating uniformity.

2) Description of Related Art

Generally, a very high frequency (VHF) required for apparatus, such as a broadcasting apparatus, a hair dryer, and a microwave oven, which uses electromagnetic wave is generated by a magnetron.

Such a magnetron generates through an antenna very high frequency energy of about 2.45 GHz when an acceleration voltage of about 4.2 KV is applied to the magnetron.

To apply the magnetron device to, for example, a microwave oven and to effectively cook a variety of food loads using the VHF energy, a guide system such as a waveguide is used to direct the VHF energy generated by the magnetron to a cooking chamber of the microwave oven.

The antenna of the magnetron device generates linear polarization energy which is radiated into the cooking chamber through a waveguide to heat the food load. FIGS. 1*a* and 1*b* show a conventional electromagnetic wave guide system employed in a microwave oven.

The conventional electromagnetic wave guide system comprises a waveguide 11, mounted on a sidewall of a cavity body 12 defining a cooking chamber 130, for guiding electromagnetic wave energy into the cooking chamber 130 through an opening 11*b*; a magnetron 10, mounted on a side of the waveguide 11, for generating the electromagnetic wave energy and radiating the same into the waveguide 11 through an antenna 10*a* projected into the waveguide 11 when a high acceleration voltage is applied from a high voltage transformer (not shown); a projection 11*a,* formed between the outer side of the waveguide tube 11 and the magnetron 10 to provide a short circuit having a length equal to that of the antenna 10*a* of the magnetron 10; and an electromagnetic wave inlet port 12*a* through which the electromagnetic wave energy radiated through the opening 11*b* of the waveguide 11 is directed into the cooking chamber 130, the electromagnetic wave inlet port 12*a* being formed on the sidewall of the cavity body 10.

When the magnetron 10 is excited by the high acceleration voltage generated by the high voltage transformer, the magnetron 10 generates electromagnetic wave energy of, for example, about 2.45 GHz, and at the same time, a turn table 14, disposed on a bottom of the cooking chamber 130 and on which food 14 is located, starts rotating.

The electromagnetic wave energy generated by the magnetron 10 is radiated into the waveguide 11 through the antenna 10*a*, then converted into a standing wave at the projection 11*a* forming the short circuit, and finally radiated into the cooking chamber 13 through the opening 11*b* and the inlet port 12*a* of the cavity body 12 to heat the food 15.

In the above, the electromagnetic wave energy is radiated from the antenna 10*a* in the form of a wave motion.

Accordingly, electromagnetic wave reflected on the projection 11*a* forming the short circuit surface is added to electromagnetic wave radiated from the antenna 10*a* at the opening 11*b* of the waveguide 11, thereby forming the standing wave.

In addition, the electromagnetic energy heats the food 15 within the cooking chamber 130 when low electric field is combined with high electric field.

However, in the above described electromagnetic wave system, the projection 11*a* formed to easily form the standing wave makes the structure of the waveguide 11 complicated. Furthermore, since a contacting area between the short circuit of the waveguide and the antenna is too small, the electromagnetic wave energy is not sufficiently radiated from the antenna, deteriorating the cooking performance.

In addition, the electromagnetic wave radiated from the antenna is inherently straight polarization having a constant polarization section with respect to its advancing direction, degrading the cooking uniformity due to an electromagnet wave interference effect occurring within the cooking chamber 130.

In the straight polarization, a polarization section of the electric filed direction in one direction is constant. That is, due to the electromagnetic wave interference, the electromagnetic wave is divided into a hot point and a weak point, by which the improvement of the cooking performance is restricted.

However, if circular polarization having a polarization section which rotates with respect to an advancing direction of the electromagnetic wave as the time goes is formed, since a direction of the electric field is continuously changed as the time goes, a reflecting angle of the electromagnetic wave transmitted to the cooking chamber 130 is also continuously changed, thereby dispersing the electromagnetic wave to a wider area to improve the cooking uniformity.

Therefore, in recent years, waveguides which can convert the electromagnetic wave energy generated from an antenna of a magnetron into the circular polarization to improve the cooking uniformity have been developed.

FIG. 2 shows a conventional circular polarization generating system which can be also applied to a microwave oven.

The conventional polarization generating system is a four port hybrid junction, comprising a rectangular waveguide 11, an electromagnetic wave source such as a magnetron is coupled on an end of the waveguide 11, a short circuit 17 disposed on the other end of the waveguide 11.

A polarization radiator 12, which is an opening or a pair of slots, is disposed on a bottom of the waveguide 11 to radiate electromagnetic wave.

In addition, electromagnetic wave energy radiated into another section of an electromagnetic wave guide 20 has left-hand circular polarization or right-hand circular polarization.

The radiator has two ports as the left-hand circular polarization and the right-hand circular polarization that are insulated from each other.

A phase shifter 19 is disposed on the short circuit 17 to shift a phase of the electromagnetic wave radiated from the radiator.

Here, when assuming that the phase shifter 19 is not disposed on the short circuit 17, electromagnetic wave energy generated from the antenna of the magnetron and transmitted to a source port 1 is dispensed to ports 4 and 2. A portion t1 of the dispensed electromagnetic wave energy a1 has the right-hand circular polarization and is radiated toward the cooking chamber through the radiator, and another portion b1 of the dispensed electromagnetic wave energy a1 is reflected after passing through the radiator 12.

Electromagnetic wave energy reflected from the port 2 is divided at the ports 1 and 2 and a portion t2 of the reflected electromagnetic wave energy a2 have the left-hand circular polarization and are radiated into the cooking chamber by the radiator. Another portion b2 of the reflected electromagnetic wave energy a2 passes through the radiator.

Since the two left-hand circular polarizations as well as the two right-hand circular polarizations have a different polarity, the formal left and right-hand circular polarizations always exist at the electromagnetic guide 20.

Therefore, the right-hand circular polarizations and the left-hand circular polarizations collide against each other, thereby forming a standing wave.

Here, if the electromagnetic wave guide 20 is a cavity body of the microwave oven, the right-hand circular polarization reflected from food is converted into the left-hand circular polarization.

A part of the reflected energy passing through the radiator is intensively coupled on the port 2 but weakly coupled on the port 1. Therefore, the electromagnetic wave energy directed to the port 2 is reflected again and converted into the left-hand circular polarization.

Therefore, the radiated electromagnetic wave energy is formed as the standing wave with the right and left-hand circular polarizations at the electromagnetic wave guide 20.

To rotate the standing wave, it is required to change one phase of the two polarizations. The phase shifter 19 disposed on a front side of the short circuit 17 of the waveguide 11 converts a phase of the left-hand circular polarization of the reflected electromagnetic wave energy, thereby rotating the standing wave. The rotating standing wave functions as a mechanical rotating opening.

The energy radiated as a rotating wave improves the heating uniformity within the cooking chamber.

In the above described circular polarization generating system, the mounting of the phase shifter and the radiator within the waveguide makes the length of the waveguide much longer and the structure thereof complicated, increasing the manufacturing costs. In addition, the long waveguide makes it difficult to dispose other electric parts within an electric part mounting chamber. Therefore, the electric part mounting chamber should be enlarged.

In an effort to solve the above described problems, a guide partition is mounted within the waveguide in the longitudinal direction to divide the interior of the waveguide into two parts, and a pair of rectangular openings are formed at an angle of 45° on both sides of the guide partition.

However, the guide partition additionally provided makes the system further complicated, and it is very difficult to precisely form the openings at the angle of 45°.

SUMMARY OF THE INVENTION

Therefore, the present invention has been made in an effort to solve the above described problems of the prior art.

It is an objective of the present invention to provide a waveguide for a microwave oven which is short in the length and simple in the structure while having the same operation effects as those of the prior art.

It is another objective of the present invention to provide a waveguide which can prevent electromagnetic wave energy from leaking by optimizing a contacting area of an antenna and a short circuit.

It is still another objective of the present invention to provide a waveguide which can increase an amount of radiation of electromagnetic wave energy, while providing a sufficient contacting area of an antenna and a short circuit.

To achieve the above objectives, the present invention provides a microwave oven comprising a magnetron for generating electromagnetic wave energy, a waveguide for guiding and directing the electromagnetic wave energy into a cavity body defining a cooking chamber, and an antenna for radiating the electromagnetic wave energy generated by the magnetron into the waveguide. The waveguide comprises a first opening for uniformly dispersing the electromagnetic wave energy into the cooking chamber, said first opening being formed on a portion of the waveguide which contacts the cavity body and extends along a longitudinal direction, and a second opening for uniformly dispersing the electromagnetic wave energy into the cooking chamber, said second opening being spaced away from and having a predetermined angle with respect to the first opening.

The wave guide further comprises a short circuit for providing a short surface to the antenna.

Preferably, the waveguide further comprises a sub-short circuit extending in a longitudinal direction of the short circuit by $\lambda$ g/4.

According to an embodiment of the present invention, the second opening is vertically disposed with respect to the first opening.

According to another embodiment of the present invention, the second opening is declined by 45–135° with respect to the second opening.

Preferably, the second opening is disposed within a length of the first opening, and each of the first and second openings is provided at its upper surface with a bead for discharging heat.

Further preferably, at least one of the first and second openings is provided with a stub, and the sub-short circuit is rounded outwardly from a central portion of the short circuit. A portion of the waveguide opposing a portion of the waveguide where the first and second openings are formed is bent upward.

According to still another embodiment of the present invention, at least one end of each of the first and second openings is circular shaped such that a width of the circular shaped end is wider than other straight portion of the openings. The second opening may lean to a side of the first opening by at least one time the width thereof.

According to yet another embodiment of the present invention, the first opening is arc-shaped

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF PREFERRED EMBODIMENTS

Preferred embodiments of the present invention will now be described in detail with reference to the accompanying drawings.

Figure 1A:
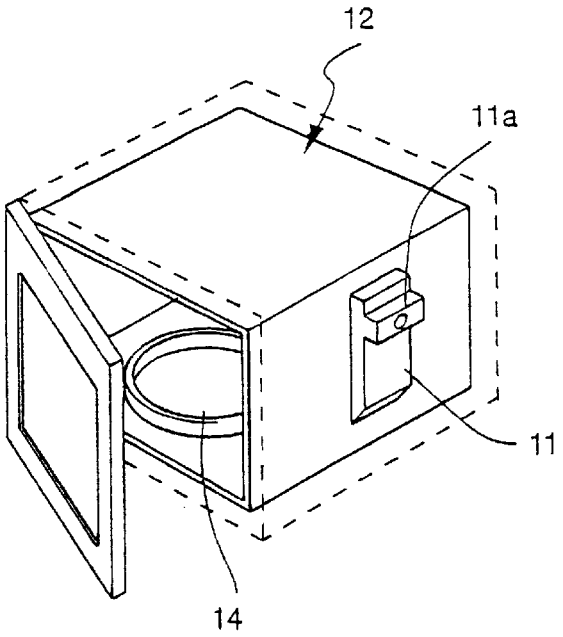
(PRIOR ART) FIG. 1a
FIG. 1*a* is a perspective view of a microwave oven where a conventional waveguide is employed.
Figure 1B:
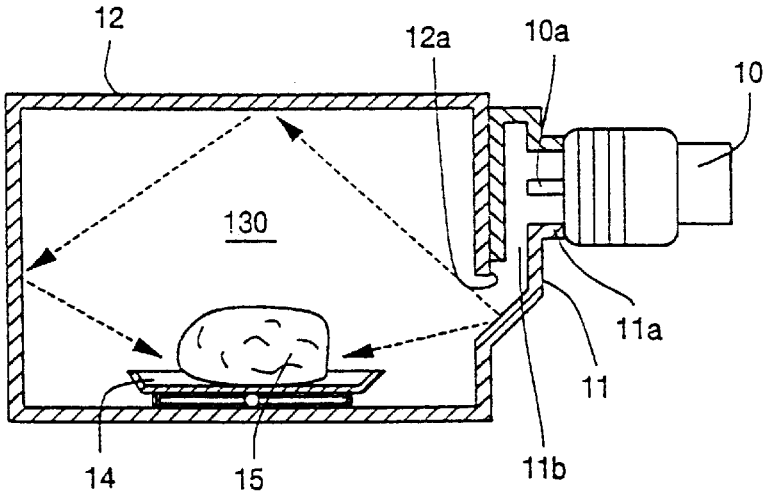
(PRIOR ART) FIG. 1b
FIG. 1*b* is a sectional view of FIG. 1.
Figure 2:
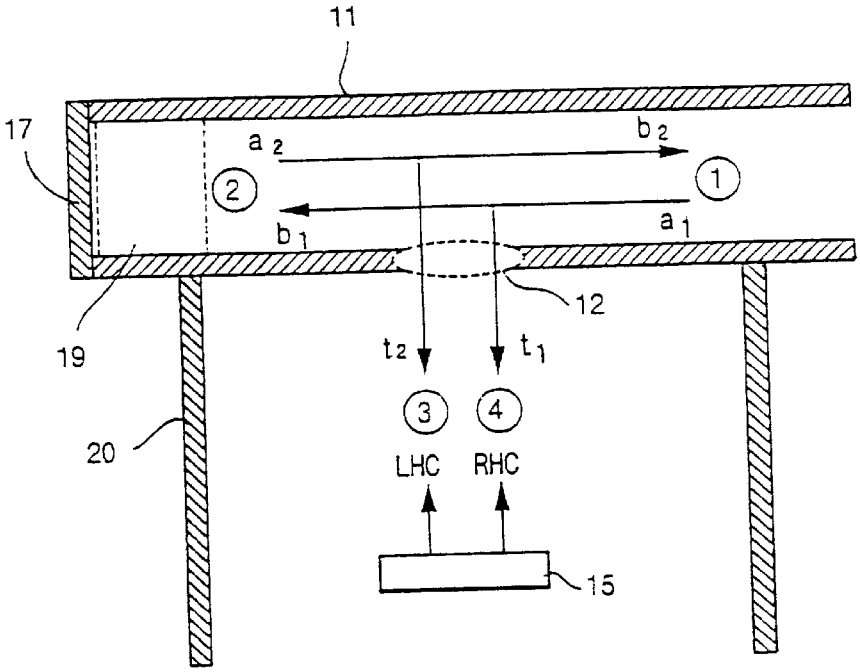
FIG. 2 (PRIOR ART)
FIG. 2 is a schematic view of a conventional waveguide.
Figure 3:
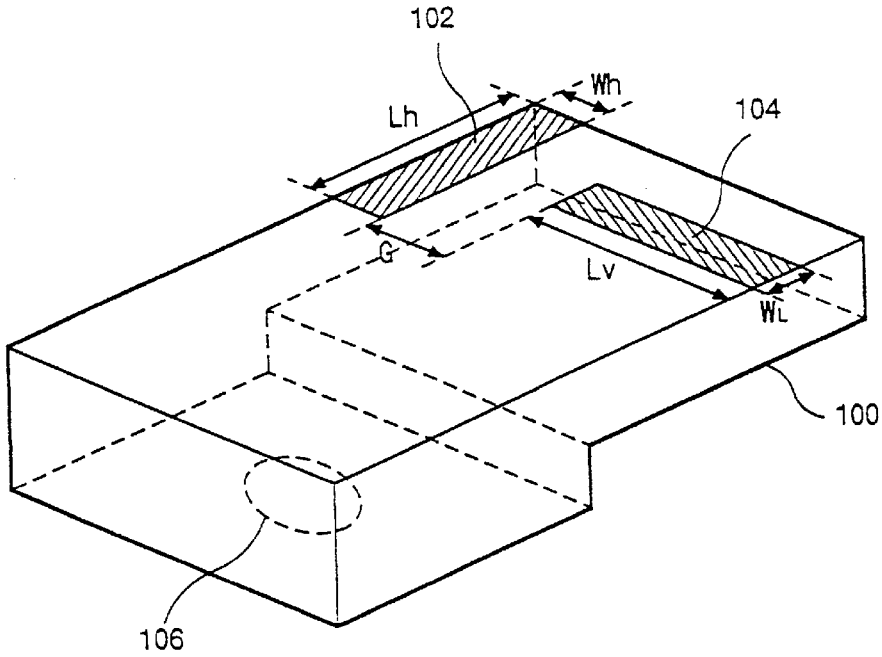
FIG. 3 is a schematic perspective view of a waveguide according to a first embodiment of the present invention.

FIG. 3 shows a waveguide according to a first embodiment of the present invention.

The inventive waveguide comprises a guide tube 100 provided with a vertical opening 102 and a horizontal opening 104 at its electromagnetic wave outlet side such that a circular polarization can be formed by a combination of a horizontal polarization and a vertical polarization when electromagnetic wave generated from a magnetron (not shown) is radiated into a chamber such as a cooking chamber of a microwave oven.

Reference numeral 106 indicates a coupling hole to which an antenna of the magnetron is inserted and coupled.

In the waveguide, when the magnetron generates electromagnetic wave, this electromagnetic wave is directed into a cooking chamber through the guide tube to heat the food load disposed within the cooking chamber.

At this point, the vertical and horizontal openings 102 and 104 perpendicularly disposed to each other convert a flat polarization of the electromagnetic wave into a circular polarization, than radiates the same into the cooking chamber.

That is, the vertical and horizontal openings 102 and 104 respectively generate a vertical polarization and a horizontal polarization. The circular polarization is formed when the vertical and horizontal polarizations are combined to each other.

Now, the circular polarization forming principle of this embodiment will be briefly described hereinafter. This principle will be applied to second to fourth embodiments, which will be described hereinbelow, as well as the first embodiment.

First, when assuming that the vertical and horizontal polarizations are identical in a size but different in a phase by 90°, a flat polarization advancing in a direction can be illustrated as a sum of electric field vector at a surface perpendicular to the advancing direction.

Therefore, when assuming that the flat polarization is advancing in a positive direction at a Z-axis, the flat polarization can be obtained according to following equations 1 and 2.

$$\vec{E}_1=\alpha_x E_1 e^{jwt-jkz} \quad \text{(Equation 1)}$$

$$\vec{E}_2\alpha_y E_2 e^{jwt-j\theta} \quad \text{(Equation 2)}$$

When combining the equations 1 and 2, a following equation 3 can be obtained.

$$\vec{E}=Re(\vec{E}_1+\vec{E}_2)=a_y E_1 \cos(\omega t-\beta z)+a_y E_2\cos(\omega t-\beta z-\theta) \quad \text{(Equation 3)}$$

In the above equation, the flat wave is varied according to conditions $\vec{E}_1$, $\vec{E}_2$ and θ

If the $E_1$, $E_2$, and $E_0$ are equal to each other, and the θ is 0, the flat wave can be illustrated as shown in a following equation 4.

$$\vec{E}=Re\ \{E_0(\alpha_x+\alpha_y)e^{jwt-jkz} \quad \text{(Equation 4)}$$

This equation shows a straight polarization having an electric field vector declined at an angle of 45° with respect to an X-axis and a size of $\vec{E}=E_0\cos(wt)$.

If the $E_1$, $E_2$, and $E_0$ are equal to each other, and the θ is π/4, the flat wave can be illustrated as shown in a following equation 4, the phase and size of the electric filed vector can be illustrated as shown in the following equation 5.

$$\begin{aligned} |\vec{E}| &= \sqrt{\left(\vec{E}_1^2+\vec{E}_2^2\right)} \\ &= \sqrt{(E_0^2\cos^2 wt+\sin^2 wt)} \\ &= E_0 \\ \varphi &= \tan^{-1}\left[\frac{E_2}{E_1}\right] \\ &= \tan^{-1}\left[\frac{E_0\sin(wt)}{E_0\cos(wt)}\right] \\ &= \tan^{-1}[\tan(wt)] \\ &= wt \end{aligned} \quad \text{(Equation 5)}$$

The Equation 5 shows that the electric filed vector rotates clockwise or counter-clockwise depending on a phase difference θ.

In addition, many elements, which affect on polarization characteristics of the electromagnetic wave generated in the waveguide 100, such as lengths Lh and Lv and widths Wh and Wv of and a distance between the vertical and horizontal openings 102 and 104 are shown in FIG. 3. Depending on values of these elements, the polarization is varied and an alignment between the magnetron, the waveguide 100 and the cavity body defining the cooking chamber can be adjusted.

That is, a direction of an electric field of the flat wave is not varied regardless of an advancing direction of an electric wave thereof, while a direction of an electric field of the circular polarization is varied as the time goes.

Figure 5:
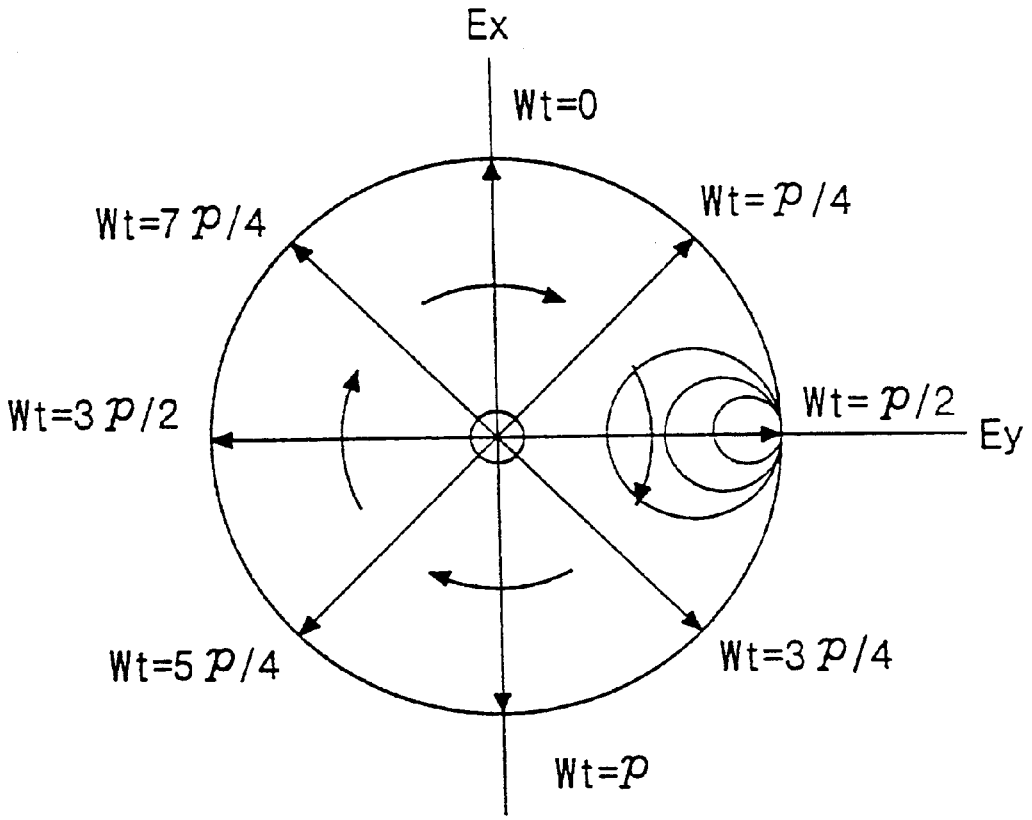
FIG. 5 is a view illustrating a variation of circular polarization as the time goes of the waveguide of the first embodiment.

The circular polarization in which the direction of the electric field is continuously varied on an x-y plane as the time goes is shown in FIG. 5.

Figure 4A:
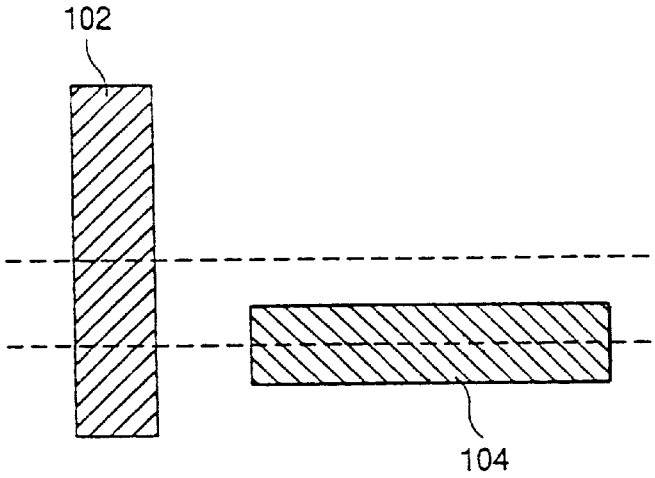
FIGS. 4*a* and 4*b* are schematic views illustrating relative position and angle of vertical and horizontal openings according to various modified examples of the first embodiment of the present invention.
Figure 4B:
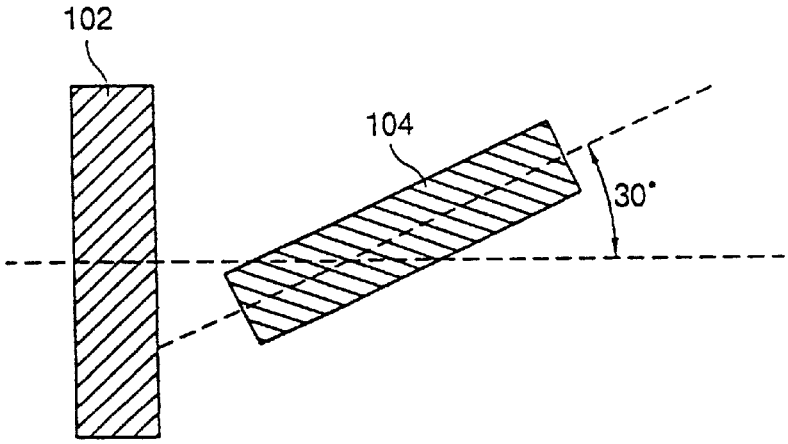

In addition, FIGS. 4*a* and 4*b* show modified examples of the waveguide depicted in FIG. 3.

Referring to FIG. 4*a,* the horizontal opening 104 is perpendicularly disposed with respect to the vertical opening 102, but leans toward one side of the vertical opening 102. The polarization characteristics of the electromagnetic wave are varied according to the leaning extent of the horizontal opening 104. Therefore, by adjusting the leaning extent of the horizontal opening 104, desired polarization characteristics can be obtained. However, the horizontal opening 104 should not get out of both ends of the vertical opening 102.

Referring to FIG. 4*b,* the horizontal opening 104 is not perpendicularly disposed with respect to the vertical opening 102 but declined at an angle within 30°. The polarization characteristics of the electromagnetic wave are varied according to the declined angle of the horizontal opening 104.

However, in the above first embodiment and the modified examples thereof, since the vertical and horizontal openings 102 and 104 are formed in a rectangular shape, the electromagnet wave may intensively be coupled at angled corners, whereby the angled comers may be excessively heated. In addition, the rectangular shape of the openings 102 and 104 causes the waveguide to be lengthened.

Therefore, in a second embodiment of the present invention, the vertical and horizontal openings are designed such that both ends of each of the openings are circular-shaped.

FIGS. 6*a* to 6*e* show examples of the vertical and horizontal openings of a waveguide according to a second embodiment of the present invention.

Figure 6A:
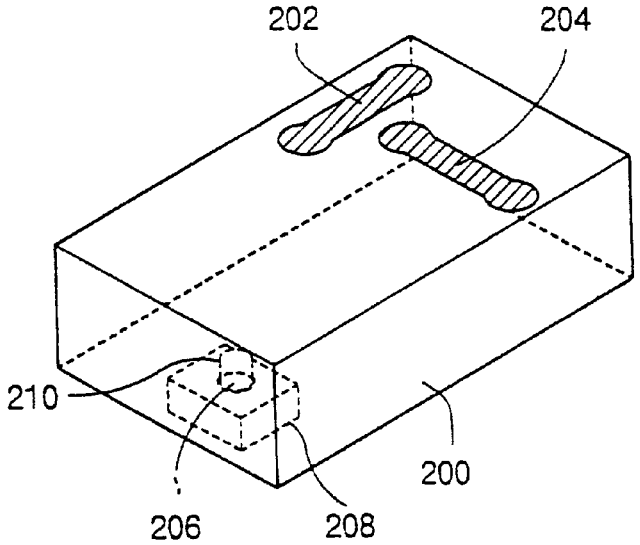
FIG. 6*a* is a schematic diagram of a waveguide according to a second embodiment of the present invention.

According to the second embodiment, as shown in FIG. 6*a,* a waveguide 200 is provided with a coupling hole 206 to which an antenna 210 of a magnetron 208 is inserted and coupled, a vertical opening 202 for directing electromagnetic wave energy generated from the antenna 210 of the magnetron 208 into the cooking chamber, and a horizontal opening 204, disposed perpendicularly to and spaced away from the vertical opening 202, for radiating the electromagnetic wave energy generated from the antenna 210 into the cooking chamber.

When an acceleration high voltage is applied to the magnetron 208 to generate electromagnetic wave energy of about 2.45 GHz, this wave energy is radiated into the waveguide 200 through the antenna 210.

The electromagnetic wave energy radiated into the wave guide 200 is divided in two type of polarizations and again combined while getting out of the vertical and horizontal openings 202 and 204 to be converted into the circular polarization. The circular polarization is radiated into the cooking chamber to uniformly heat the food.

Figures 9A, 9B:
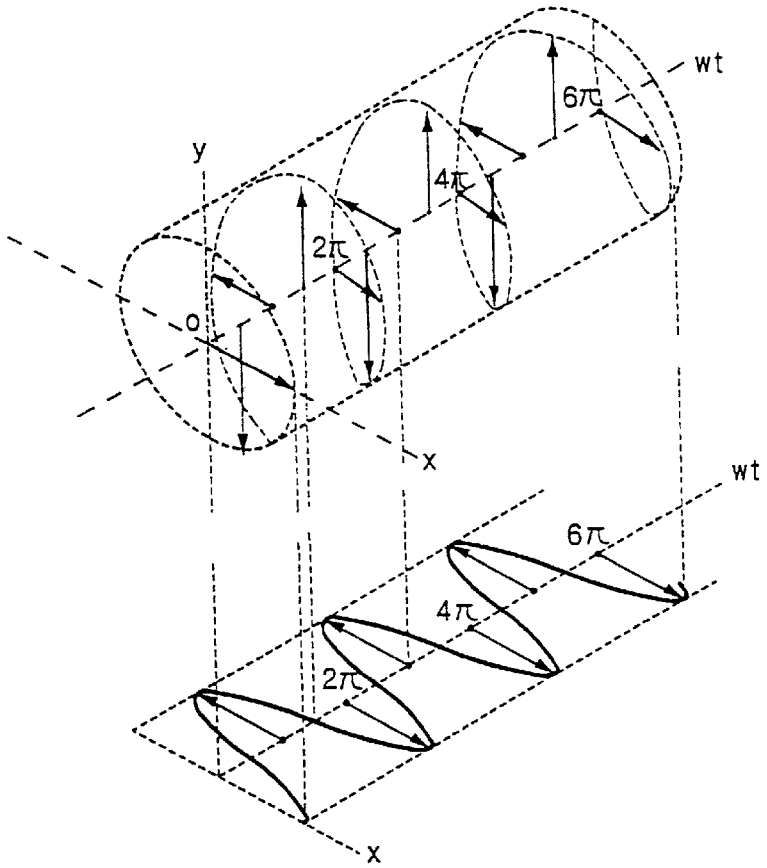
FIGS. 9*a* and 9*b* show a relationship between a straight polarization and a circular polarization.

As is well known, in the conventional microwave oven, since the electromagnetic wave energy has a straight polarization characteristic as shown in FIG. 9*b,* the food cannot be uniformly heated.

However, in this embodiment, as shown in FIG. 9*a,* the circular polarization has a characteristic in that electric directional vector rotates as the time goes.

In addition, since the rectangular vertical and horizontal openings of the first embodiment may degrade the uniform radiation, in this embodiment, both ends of each of the openings 202 and 204 are designed to have a circular shape. Preferably, each width of the circular-shaped portions is wider than other straight portion of each opening.

The circular-shaped ends enhance the dispersion of the electromagnetic wave and makes it possible to shorten the length of the waveguide.

The circular-shaped portion may be formed on both ends of each of the openings or only one end of each of the openings. In addition, both ends of the vertical opening 202 may be circular-shaped while only one end of the horizontal opening 204 may be circular-shaped.

Now, the circular polarization forming principle of this embodiment will be briefly described hereinafter.

As shown in FIG. 6*a,* when assuming that the vertical opening 202 generates a polarization of a y-direction, the electric field $\vec{E}$ is as follows:

$$\vec{E}=\hat{y}E_1\angle\Phi_1$$

where, $\hat{y}$ is a unit vector in a direction of y, $E_1$ is a size of the vector, and $\emptyset_1$, is a phase.

In addition, when assuming that the horizontal opening 204 generates a polarization advancing in a direction of x-, the electric field $\vec{E}$ is as follows:

$$\vec{E}=\hat{x}E_2\angle\Phi_2$$

where, $\hat{x}$ is a unit vector of an x-direction, $E_2$ is a size of the vector, and $\emptyset_2$ is a phase.

Therefore, to generate the circular polarization, the following conditions are satisfied:

$$|\emptyset_1-\emptyset_2|=\pi/2, \text{ and } |E_1/E_2|=1$$

Figure 6B:
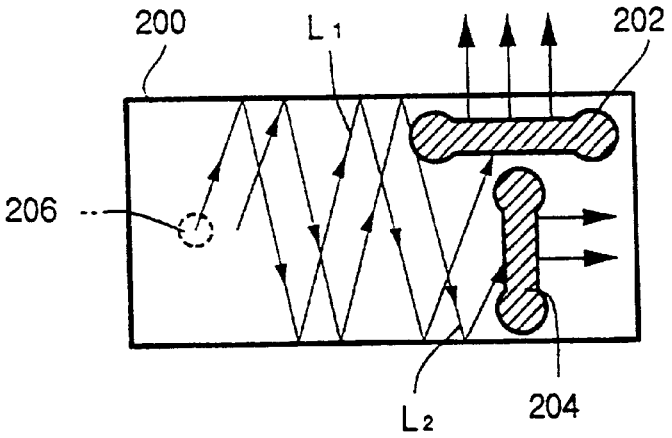
FIG. 6*b* is a plane view of the waveguide of FIG. 6*a;*

To generate circular polarization having the above characteristics, as shown in FIG. 6*b,* the locations of the vertical and horizontal openings should be determined according to the following equation:

$$|L1-L2|=\lambda_0/4, \text{ that is, } K_0|L1-L2|=\pi/2$$

where, $K_0$ is the number of waves, that is, $2\pi/\lambda_0$.

In the second embodiment, an axis ratio (y/x in FIG. 4) of the circular polarization attained by the structure of the waveguide is less than about 4.

Figure 6C:
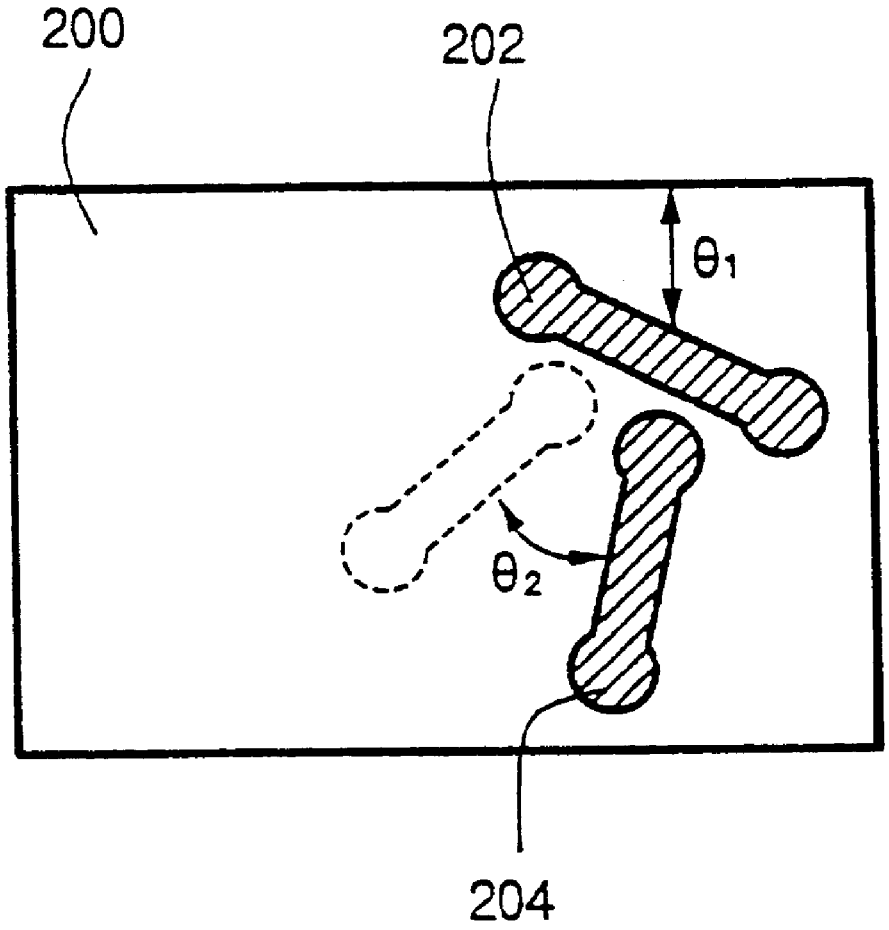
FIGS. 6*c,* 6*d,* 6*e,* and 6*f* are schematic views illustrating relative position and angle of vertical and horizontal openings according to various modified examples of the waveguide of the second embodiment.

As modified examples of this embodiment, the horizontal opening 204 may not be perpendicularly disposed to the vertical opening 202, but may be inclined at an angle of 45° or, as shown in FIG. 6*c,* the vertical opening 202 can be disposed at a predetermined angle θ1, for example, 45° with respect to a side wall of the waveguide 200, and the horizontal opening 204 is disposed at a predetermined angle θ2, for example, 45–135° with respect to the vertical opening 202.

In addition, the vertical opening 202 is preferably disposed to lean toward a side of the horizontal opening 204 more than two times the width thereof.

Polarization characteristics of electromagnetic wave are varied in accordance with relative position and angle of the vertical and horizontal openings 202 and 204. Therefore, by adjusting the relative position and angle, desired polarization characteristics may be attained.

Figure 6D:
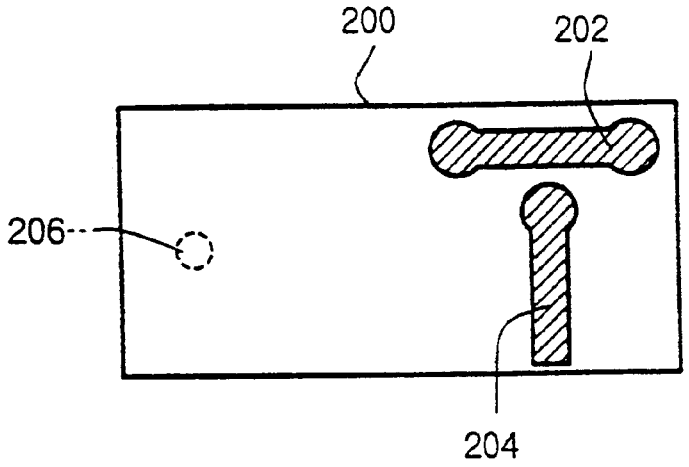
Figure 6E:
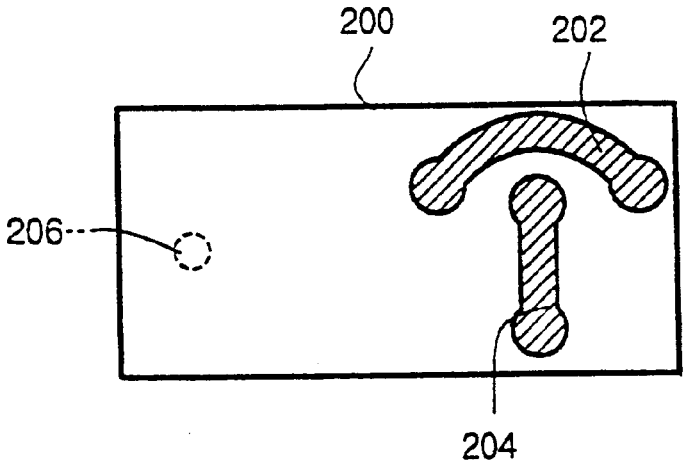

FIGS. 6*d* and 6*e* show another modified examples of the second embodiment. These modified examples show various shapes of the vertical and horizontal openings 202 and 204.

Referring to FIG. 6*d,* one end of the horizontal opening 204 proximal to the vertical opening 202 is circular-shaped wider than the other end thereof distal from the vertical opening 202. Referring to FIG. 6*e,* the vertical opening 202 is arc-shaped.

As described above, by changing the shapes of the vertical and horizontal openings 202 and 204, a desired polarization can be attained.

In these modified examples, the relative position and angle of the vertical and horizontal openings 202 and 204 can be adjusted to attain desired polarization.

In addition, it is preferable to mount a bead on each upper portion of the vertical and horizontal openings 202 and 204 to discharge heat.

That is, to inspect an abnormal state of the microwave oven, when operating only the magnetron 208 without operating other components, electromagnetic wave energy passes through the vertical and horizontal openings 202 and 204. At this point, a high temperature heat is generated by a collision of electromagnetic wave energy on a surface of the waveguide 200, causing electric parts to be damaged.

Therefore, to prevent this, the bead is mounted on the vertical and horizontal openings 202 and 204 to discharge the heat.

Figure 7A:
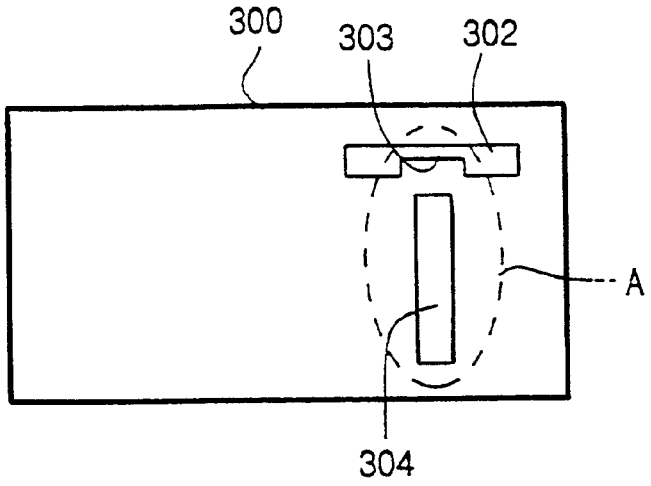
FIG. 7*a* is a plane view of a waveguide according to a third embodiment of the present invention.
Figure 7B:
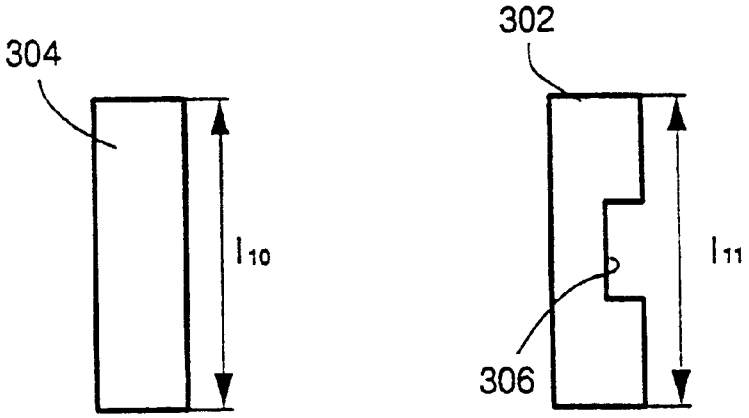
FIG. 7*b* is an enlarged view of vertical and horizontal openings depicted in FIG. 7*a;*

FIGS. 7*a* and 7*b* show a waveguide according to a third embodiment of the present invention.

In the third embodiment, vertical and horizontal openings 302 and 304 of a waveguide 300 are rectangular-shaped, and the vertical opening 302 is provided with stub 306 as shown in FIG. 7*b* to effectively disperse electromagnetic wave. Therefore, although the length L10 of the horizontal opening 304 is mechanically equal to that of the vertical opening 302, but electrically longer than that of the same due to the stub.

Figure 8A:
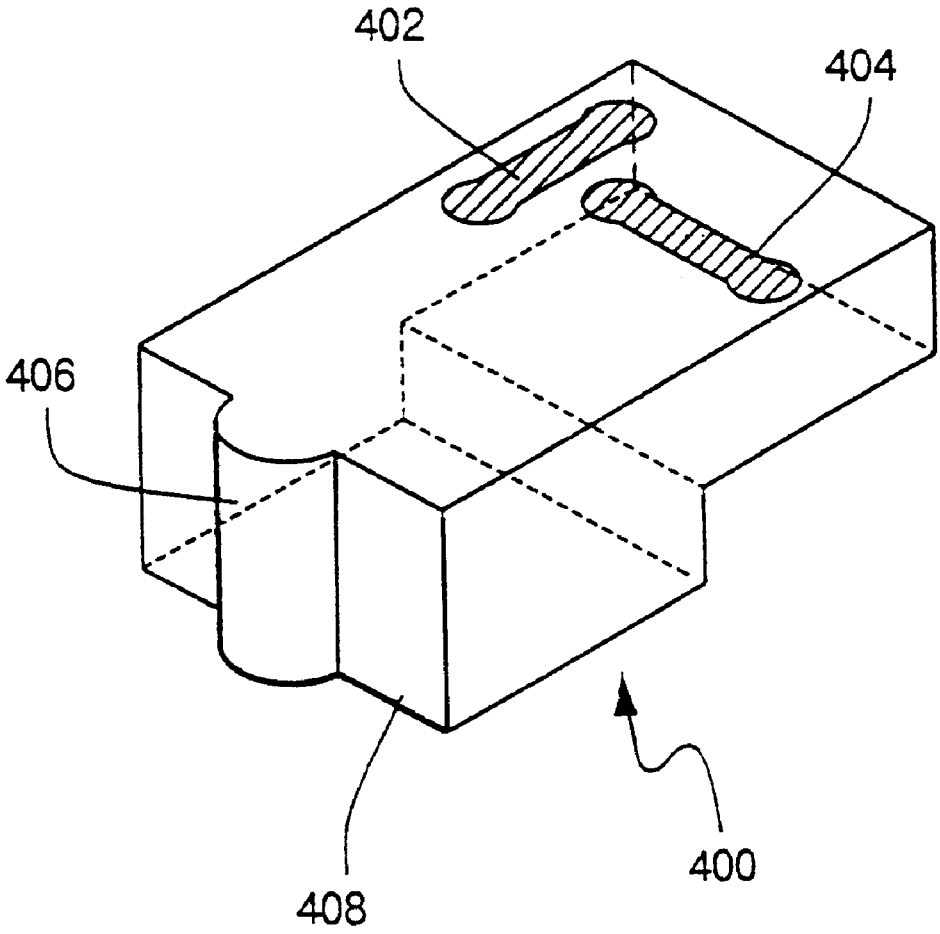
FIG. 8*a* is a perspective view of a waveguide according to a fourth embodiment of the present invention.
Figure 8B:
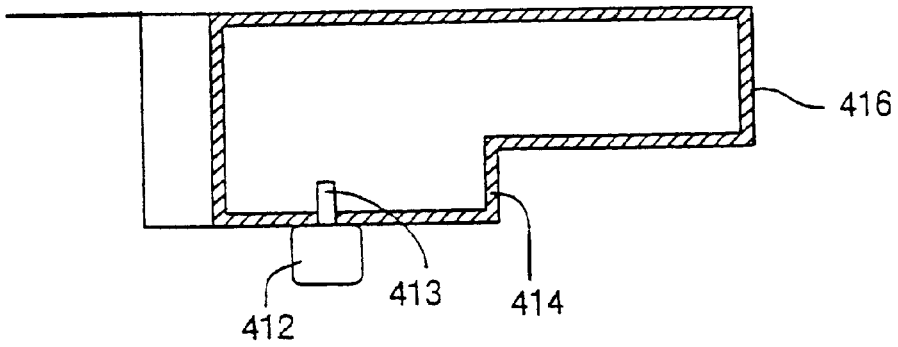
FIG. 8*b* is a side view of the waveguide of FIG. 8*a;*
Figure 8C:
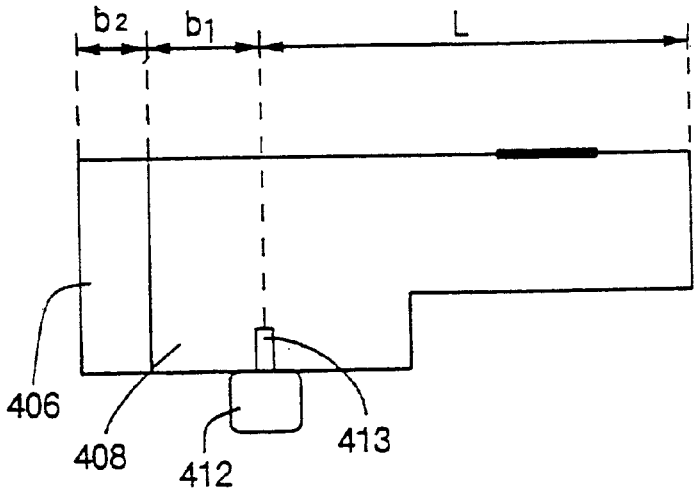
FIG. 8*c* is a schematic view illustrating an impedance of the waveguide of FIG. 8*a;*

FIGS. 8*a* to 8*c* show a waveguide according to a fourth embodiment of the present invention.

A waveguide according to the fourth embodiment comprises a vertical opening 402 formed in a longitudinal direction of the waveguide to uniformly disperse electromagnetic wave energy generated by an antenna of a magnetron 412 into the cooking chamber of the microwave oven, a horizontal opening 404 disposed perpendicular to the vertical opening 402 to uniformly disperse the electromagnetic wave energy into the cooking chamber, a sub-short circuit plate or surface 406 extending in a longitudinal direction of a short circuit plate and short-contacting the antenna 413 at a distance of λ g/4, and a stepped portion 414 and a slope 416 formed on a portion of the waveguide 400 opposing a portion of the waveguide 400 where the vertical and horizontal openings 402 and 404 are formed.

The sub-short circuit plate 406 of the waveguide 400 is preferably formed by outwardly rounding a central portion of the short circuit 408 plate of the waveguide 400.

In the fourth embodiment, when an acceleration high voltage generated by a high voltage transformer is applied to the magnetron 412, electromagnetic wave energy of 2.45 GHz is radiated from the magnetron 412 through the antenna 413, then directed into the waveguide 400. The electromagnetic wave energy directed into the waveguide 400 is advanced toward the stepped portion 414 and the slope 416 via the sub-short circuit surface 406.

The electromagnetic wave energy advanced to the slope 416 is reflected thereon, divided through the vertical and horizontal openings 402 and 404, then combined again into circular polarization which is radiated into the cooking chamber to uniformly heat the food.

Here, since the sub-short circuit surface 406 short-contacts the antenna at the distance of λ g/4, the distance between the short-circuit 408 and the antenna 413 becomes smaller than λ g/4 by a distance b2 of the sub-short circuit.

That is, as shown in FIG. 8*c*, if the distance from a central axis of the antenna 413 to the short circuit 408 is b1 and the distance between the short circuit 408 to the sub-short circuit 406 is b2, the total short contacting area of the antenna 413 becomes "b1+b2".

As described above, the short contacting area of the antenna 413 becomes larger by the sub-short circuit 406, the electromagnetic wave energy does not leak through the contacting portion, thereby radiating a large amount of the circular polarization into the cooking chamber to uniformly heat the food.

Figure 10A:
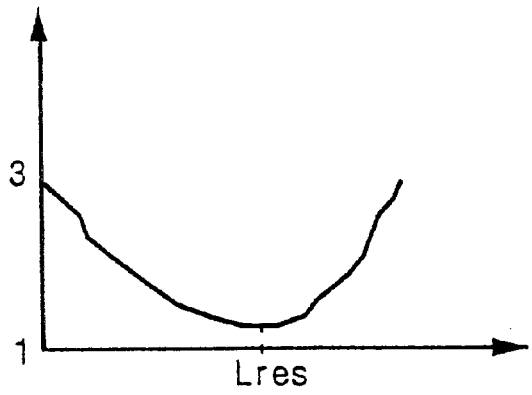
FIG. 10*a* is a graph illustrating a standing wave ratio according to a change in a length of a pair of opening.
Figure 10B:
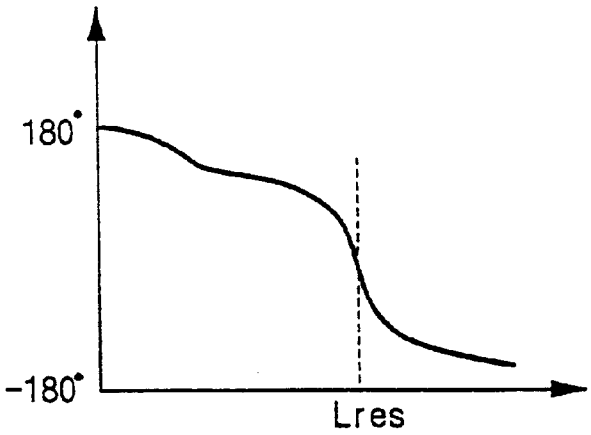
FIG. 10*b* is a graph illustrating a phase characteristic according to a change in a length of a vertical opening.

FIGS. 10*a* and 10*b* show graphs illustrating characteristics of the coupling holes disclosed in the first to fourth embodiments.

Referring to FIG. 10*a*, the standard wave ratio SWR becomes minimized when the vertical and horizontal openings are within a resonance length. Phase sensitivity is high as shown in FIG. 10*b*.

What is claimed is:

1. A microwave oven comprising:

a magnetron for generating electromagnetic wave energy;

a waveguide for guiding and directing the electromagnetic wave energy into a cavity body defining a cooking chamber; and an antenna for radiating the electromagnetic wave energy generated by the magnetron into the waveguide, wherein the waveguide comprises:

a first opening for dispersing the electromagnetic wave energy into the cooking chamber, said first opening being formed on a portion of the waveguide which contacts the cavity body and extends along a longitudinal direction; and a second opening for dispersing the electromagnetic wave energy into the cooking chamber, said second opening being elongated in a horizontal direction and being spaced away from and having a predetermined angle with respect to the first opening and said first and second openings being so sized and shaped as to generate circular polarization.

2. The microwave oven of claim 1 wherein the second opening is vertically disposed with respect to the first opening.

3. The microwave oven of claim 1, wherein the second opening is inclined by an angle in the range of 45–135° with respect to the first opening.

4. The microwave oven of claim 3 wherein at least one end of each of the first and second openings is circular shaped such that a width of the circular shaped end is wider than other straight portion of the openings.

5. The microwave oven of claim 1 wherein the second opening is disposed within a length of the first opening.

6. The microwave oven of claim 5 wherein the second opening leans to a side of the first opening by at least one time the width thereof.

7. The microwave oven of claim 1 wherein each of the first and second openings is provided at its upper surface with a bead for discharging heat.

8. The microwave oven of claim 1 wherein at least one of the first and second openings is provided with a stub.

9. The microwave oven of claim 1 wherein a portion of the waveguide opposing a portion of the waveguide where the first and second openings are formed is bent upward.

10. The microwave oven of claim 1 wherein the first opening is arc-shaped.

11. A waveguide used in an apparatus using a very high frequency, said apparatus has a cavity body defining a chamber to which electromagnetic wave energy generated from a magnetron through an antenna is radiated, the waveguide comprising:

a first opening for dispersing the electromagnetic wave energy into the chamber, said first opening being formed on a portion of the waveguide which contacts the cavity body and extends along a longitudinal direction; a second opening for dispersing the electromagnetic wave energy into the chamber, said second opening elongated in a horizontal direction and being spaced away from and having a predetermined angle with respect to the first opening and said first and second openings being so sized and shaped so as to generate circular polarization; and a sub-short circuit plate extending in a longitudinal direction from the antenna.

12. The microwave oven of claim 11 wherein the second opening is vertically disposed with respect to the first opening.

13. The microwave oven of claim 11, wherein the second opening is inclined by an angle of 45–135° with respect to the first opening.

14. The microwave oven of claim 13 wherein the sub-short circuit is rounded outwardly from a central portion of the short circuit.

15. The microwave oven of claim 11 wherein the second opening is disposed within a length range of the first opening.

16. The microwave oven of claim 15 wherein at least one end of each of the first and second openings is circular shaped such that a width of the circular shaped end is wider than other straight portion of the openings.

17. The microwave oven of claim 11 wherein each of the first and second openings is provided at its upper surface with a bead for discharging heat.

18. The microwave oven of claim 17 wherein the second opening leans to a side of the first opening by at least one time the width thereof.

19. The microwave oven of claim 11 wherein at least one of the first and second openings is provided with a stub.

20. The microwave oven of claim 11 wherein a portion of the waveguide opposing a portion of the waveguide where the first and second openings are formed is bent upward.

21. The microwave oven of claim 11 wherein the first opening is arc-shaped.

* * * * *